United States Patent [19]

Helwig

[11] 4,156,872

[45] May 29, 1979

[54] DISPLAY ELEMENT WRITE SENSOR

[75] Inventor: Gordon Helwig, Mississauga, Canada

[73] Assignee: Ferranti-Packard Limited, Mississauga, Canada

[21] Appl. No.: 898,701

[22] Filed: Apr. 21, 1978

[51] Int. Cl.[2] ..... G08B 5/22

[52] U.S. Cl. ..... 340/373; 340/378.2; 340/166 R

[58] Field of Search ..... 340/373, 378 R, 166 R, 340/336

[56] References Cited

U.S. PATENT DOCUMENTS 4,069,480 1/1978 Helwig ..... 340/373

*Primary Examiner*—Harold I. Pitts

[57] ABSTRACT

A drive is provided for a rotatably mounted display element which is distinctively colored on opposite sides and having a magnet rotatable therewith defining a magnetic axis transverse to the axis of rotation, a pole piece of reversible permanently magnetizable material, designed so that the reversible field of said pole piece will produce opposite orientations of said display element, a coil for energizing said pole piece. There is provided means for determining from the characteristics of current resulting from voltage applied to said coil whether or not the polarity of said pole piece is being reversed.

4 Claims, 5 Drawing Figures

DISPLAY ELEMENT WRITE SENSOR

BACKGROUND OF THE INVENTION

This invention relates to the operation of an electromagnetic indicator element used either alone, in small groups or as part of a large display.

No search has been performed prior to the filing of this application and the closest, prior art known to applicant is constituted by applicant's prior patents recited below.

Such indicator elements are each designed to selectively display one of two contrastingly coloured faces so that information may be displayed or "written" by the array, by the combined visual effects of the faces displayed by the individual elements.

Such rotatably mounted elements carry magnets and their orientation is controlled by a magnetizable member or pole piece, the sense of whose magnetization is determined by a winding and whose magnetic field controls the orientation of the corresponding element in accord with the sense of magnetization.

Electromagnetic elements of the type referred to are shown in U.S. Pat. Nos. 3,469,258 dated Sept. 23, 1969; 3,975,728 dated Aug. 17, 1976; 3,140,553 dated July 14, 1964; 3,624,941 dated Dec. 7, 1971; 3,365,824 dated Jan. 30, 1968; 3,295,238 dated Jan. 3, 1967; 3,303,494 dated Feb. 7, 1967; 3,754,245 dated Aug. 21, 1973; although the practical value of the invention described herein will be of more value in connection with the devices of some of these patents, than others.

SUMMARY OF THE INVENTION

The invention is believed to have its principal application to rotatably mounted discs of the types shown in the patents listed above. However, the invention is also applicable to electromagnetically operable display elements which are cylinders or sphere and/or do not have a fixed pivotal axis. Examples of electromagnetic display or indicator elements of the latter type are shown in U.S. Pat. No. 3,469,258 dated Sept. 23, 1969 and in U.S. Pat. No. 3,444,551 dated May 13, 1969. The invention may also be applied to devices using movable levers instead of discs, as, for example, in U.S. Pat. No. 3,537,197 dated Nov. 3, 1970.

The display devices other than disc with which the invention is used, have in common with the disc the characteristics that: the display element is movable between two orientations to give a different visual appearance and has a magnet movable therewith, a pole piece of reversible permanently magnetizable material designed and arranged so that the two directions of the reversible field of said pole piece will respectively produce the two orientations of said display element, and a coil for energizing said pole piece.

Although electromagnetic display elements of the type described and of the type shown in the patents may have their orientation controlled by a soft iron pole piece magnetized by a continuous current, for most practical purposes such elements are controlled by a reversible permanently magnetizable pole piece. By 'reversible permanently magnetizable material' is meant material where the magnetization may be reversed by the application of flux of sufficient strength in the desired sense, but which material, when the magnetizing flux is removed, retains sufficient remanence flux to maintain the associated display element in its orientation. Thus the magnetization or reversal of magnetization of a pole piece of said material may be achieved by a short pulse of current through the associated coil followed by a period where no current is in the coil. During the period of no current the electromagnetically actuable element is held in the orientation corresponding to the polarity of the last pulse by the remanence flux of the pole piece. When the information displayed or indicated is to be changed, a further current pulse will be supplied through the winding in the desired sense to ensure the selected polarity of magnetization in the pole piece. It should here be explained that, in a array encompassing a large number of display elements, the corresponding coils are pulsed in a direction to create, in each pole piece, the magnetization to produce the desired orientation of the element, whether or not a particular pole piece is already magnetized in the desired sense. The invention is concerned with displays in the desired sense. The invention is concerned with displays operated in the last mentioned mode.

The invention takes advantage of the fact that, for a pulse of predetermined voltage in a selected sense through a coil the current will rise faster if the pole piece with which the coil is associated, is already magnetized in the sense corresponding to that of the pulse than if the current in the coil is being applied to switch the magnetization of the pole piece.

The detection of the rise time of the current and the resulting informaton that the display element in question has been altered in magnetism or not may be used as check to detect errors in switching so that errors in the "writing" of the information may thus be detected. Moreover the information "written" on a display may be determined by blanking the sign i.e. by pulsing each of the elements to cause it to display the same colour (or another predetermined pattern). By such pulsing to produce a uniform colour, (or predetermined pattern) the detection above described may be used to determine which elements were switched and which were not and hence which were of one colour and which of another. Obviously the detected information may be recorded or otherwise used to cause the information (if correct) to be again written on the sign.

It is therefore an object of the invention to provide; in combination with an electromagnetic display element and means for providing a magnetizing current pulse to a reversible, permanently magnetizable pole piece thereof; means for determining from the characteristics of the magnetizing current of the pulse whether the pole piece was already magnetized in the sense of the current or is magnetized in the opposite sense thereby.

BRIEF DESCRIPTION OF THE DRAWINGS

In drawings which illustrate a preferred embodiment of the invention.

DESCRIPTION OF THE PREFERRED EMBODIMENT

Figure 1:
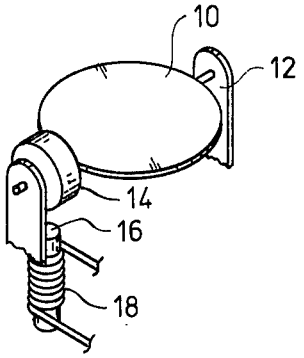
FIG. 1 shows a typical electromagnetically operated disc with which the invention would be used.

In the drawings: FIG. 1 shows a disc 10 pivotally mounted on brackets 12 for rotation therewith. A magnet 14 is mounted for rotation with the disc 10 and is selected to define a magnetic axis both perpendicular to the rotational axis of the disc and perpendicular to the disc itself. A pole piece 16 is supported on the same base (not shown) as the brackets. The pole piece 16 is oriented and located to produce a magnetic field which will control the orientation of the magnet 14 and disc 10. An energizing coil 18 is shown wound about the pole piece for controlling the magnetization thereof. The pole piece is made of reversible permanently magnetizable material as previously discussed and defined. Thus it will be switched by a pulse of predetermined voltage applied to coil 18 in a selected polarity to produce the magnetization and no signal will be supplied between pulses.

Figure 2:
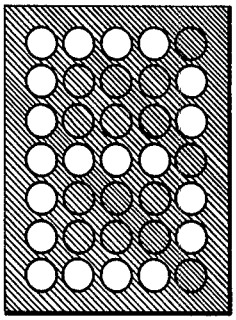
FIG. 2 shows a module of a display formed from elements such as those in FIG. 1.

FIG. 2 shows a part of a display being a module of thirty-five elements of the type of FIG. 1 arranged in seven rows and five columns to produce letters or numbers in accord with the selective energization of the element discs to display their dark or their light side. The module shown is displaying a 'B'. It will assist with the discussion to follow if it is noted that if the module shown is energized to show a 'P' after the 'B' all elements will retain the same energization and hence the same sense of magnetization of their respective pole pieces except the right hand elements in the 5th and 6th rows and the middle three elements in the 7th row.

Figure 3:
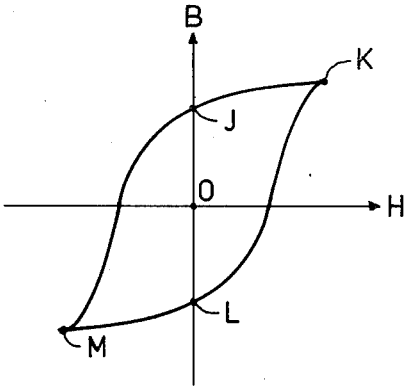
FIG. 3 shows a B-H curve for a pole piece.

FIG. 3 shows a B-H curve for a pole piece where, with no current through coil 18, the sense of magnetization of the pole piece will be represented by point J or L depending on the disc colour to be displayed, we will assume that the magnetization is at point J. It will be seen that line J-O represents the strength of the remanence flux. If the coil 18 is pulsed in a sense to reverse the magnetization of the pole piece 16, then the magnetic state of the pole piece 16 will be represented by its line from J to M then by the line from M to L when the pulse is removed. The magnetic state of the pole piece is thus carried away from saturation through O flux at the H axis toward saturation at M in the other direction. On the other hand, if the current pulse is applied in the direction in which the pole piece is already magnetized, the state of the core travels along the line from J to K then back from K to J after the cessation of the pulse. As the core at J is already nearly saturated in one sense the current for a given applied voltage will rise much faster when it is altering the flux state from J to K than when it is altering the flux state from J to M. Thus detection of the rate of rise of current resulting from the the application of voltage will allow determination of whether the coil is being energized in the same or opposite sense to its last energization or to the magnetization already present. Thus, with the pole pieces energized to form a B, as shown in FIG. 2, if the pole pieces are energized to produce a P, the current for the pole pieces of each of the elements except those changing will rise relatively rapidly while for the five elements which are switching from white to black will rise more slowly.

Figure 5:
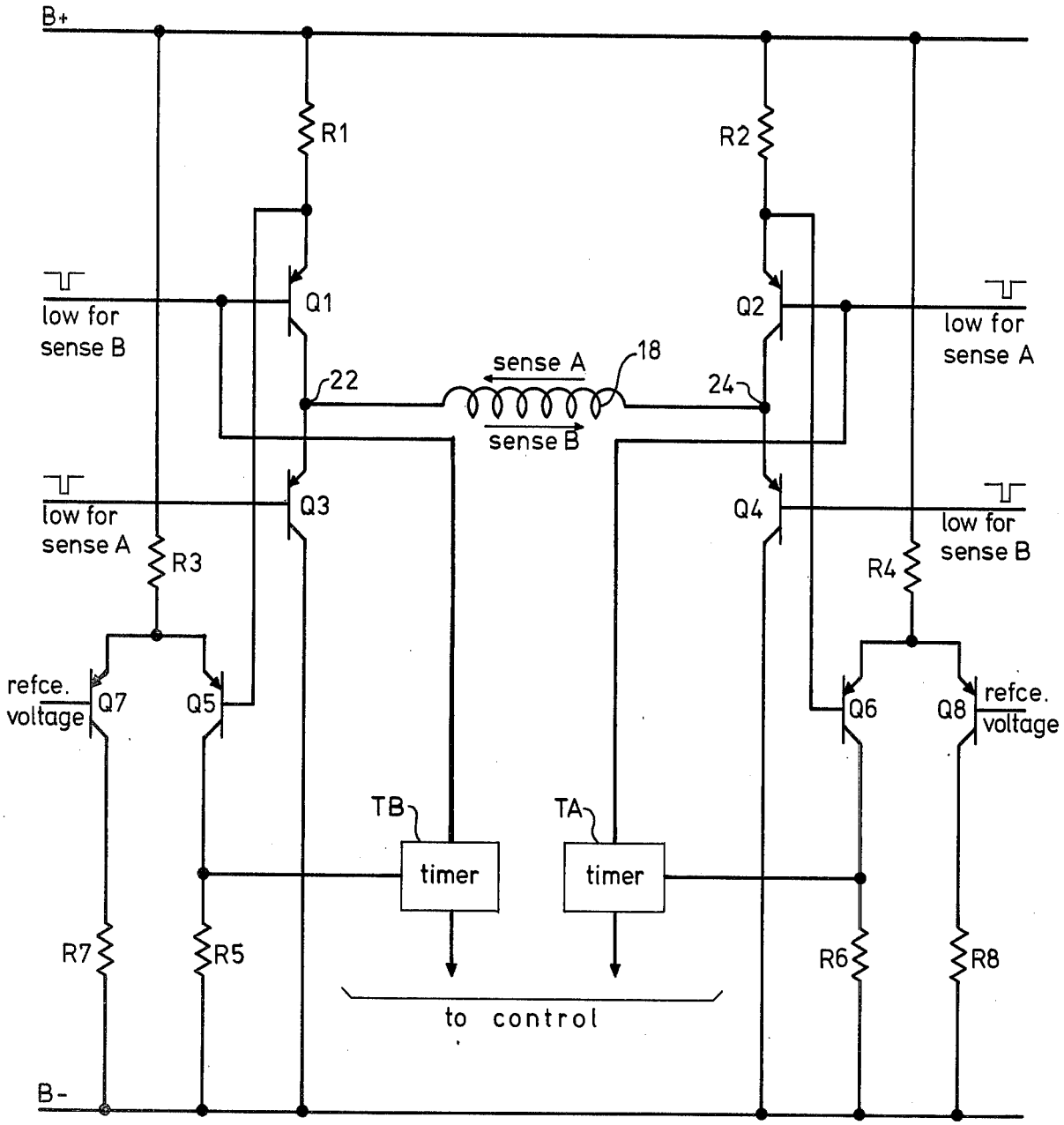
FIG. 5 shows a circuit for detecting the current characteristics of the magnetizing circuit.

A preferred means for detecting the rise in current will now be disclosed in connection with means for energizing a coil. Although the means for energizing the coils in an array with hundreds or thousands of such elements involves a multiplication of circuitry, the invention may be explained herein in relation to the circuitry involved in energizing a single coil 18. FIG. 5 shows the coil 18 connected between nodes 22 and 24. A positive voltage datum B+ is connected through resistor R1 to the emitter of PNP transistor Q1 whose collector is connected through coil 18 to the emitter of PNP transistor Q4. The collector of transistor Q4 is connected to negative voltage B−. Similarly voltage datum B+ is connected through resistor R2 to the emitter of PNP transistor Q2 whose collector is connected through coil 18 to the emitter of PNP transistor Q3. The collector of transistor Q3 is connected to B−. When it is desired to apply energizing current to the coil in sense 'A' negative pulses are supplied to the bases of transistors Q2 and Q3 to render these transistors conducting and for the time required to produce the desired magnetization subject to current limiting as referred to hereafter. Q2 and Q3 conducting will cause current flow through the coil in sense 'A'. The magnitude of the energizing current is measured by the resistance drop across R2. When the pulse ceases Q2 and Q3 cease to conduct and current ceases through the coil. Similarly, when it is desired to energize the coil in sense 'B' the bases of Q1 and Q4 are negatively pulsed and the magnitude of current flowing through the coil in sense 'B' is measured by the drop across resistor R1.

The side of resistor R1 remote from B+ is connected to comparator having transistors Q7 and Q5. With no current in R1, Q7 conducts, Q5 does not. When the voltage at the base of Q5 reaches a sufficiently low value, determined by the reference voltage applied to the base of Q7, Q5 conducts providing a signal to timer TB. The reference voltage of the base of Q7 is selected so that Q7 turns on when the voltage has almost reached the level necessary to energize the coil to switch (if necessary) the polarity of the pole piece. Similarly the side of R2 remote from B+ is connected to a similar comparator comprising transistors Q6 and Q8.

Figure 4:
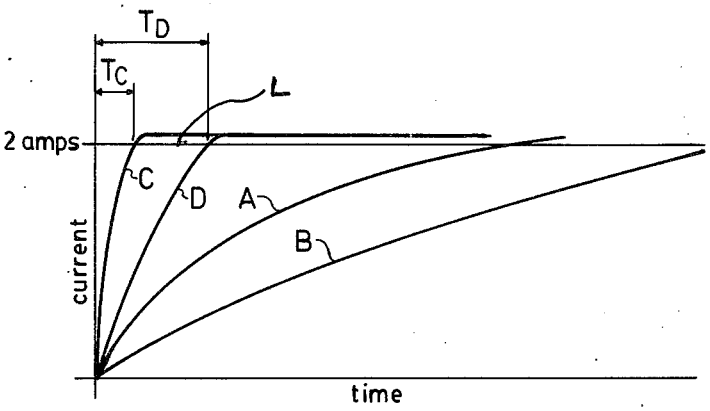
FIG. 4 is a graph showing current-time characteristics.

FIG. 4 shows as graphs A and B the current rise with time where the voltage level of the pulse is just sufficient to cause the current to gradually reach the required level for switching the core, represented by the level L. A representing the curve when the pole piece is already magnetized in the right sense and B the curve when the magnetization is being switched. (The time scale is greatly expanded over FIG. 4 and the decrease of current at the end of a pulse is not indicated to the right). Although the current rise times represented by such curves A and B show a time differential for detection, their flatness makes design for consistent detection of the current rise time difficult. It is found preferable to apply a much bigger voltage than required e.g. 28 volts to produce 2 amps through a 3 ohm load to produce the rise of current with time represented by curve C in the situation where the pole piece is already magnetized in the correct sense and by curve D in the situation where the pole piece is previously magnetized in the opposite sense. These steep curves C and D are nearly straight lines over the up to level L and the timer may easily detect the difference between time TC for example 100 m sec and TD 300 m sec. With this arrangement the high voltage, if maintained would in many cases burn out the equipment, and therefore it is necessary to limit the voltage and current, for the duration of the pulse after. This may be achieved in many ways but one way is to provide the connections from nodes 22 and 24 to provide respective signals to a control not shown to limit the current to just above level L (here two amps) for the duration of the pulse interval after the level L is reached.

It will be noted that a bifilar winding may be used, in which case one winding would be connected in a circuit between transistors Q1 and Q4 for energization in one sense and the other winding would be connected in a circuit between Q2 and Q3 for energization in the opposite sense, and the two circuits are independent but with detecting means as shown.

It will be noted that the term coil includes a straight wire through a magnetic full or part loop as shown in U.S. Pat. Nos. 3,942,274 or 3,140,553, previously referred to.

The timers TB and TA are designed to incorporate logic or discriminating means to determine whether the rise time TC or TD of the current corresponds to curve C or curve D. Thus with the change from the B of FIG. 2 to a P, as noted, a fast rise of current (i.e. curve C) will be detected by detecting rise time TC in "writing" each of the elements except the last two of rows 5 and 6 and the middle three elements of row 7. These latter will each show the slower current rise time i.e. TD of curve D as the magnetization of the pole pieces is being switched. Thus any deviation in the results detected as rise times from those expected from the patterns to be written may be used to provide an error signal which may be used to cause (for example) rewriting of the desired element or blanking (turning all the elements to one colour) of the display.

The detection method of the invention may also be used to 'read' what was the state of the sign. Thus with a "B" as shown in FIG. 2 the drive for the sign elements may be applied to "blank" the display, i.e. to energize each of the elements to show its dark side. This, with the detecting means shown, will result in energizing all black elements in the direction in which they are already magnetized producing for each a current rise time TC and energizing the white elements in the opposite direction and producing for each a current rise time TD. The detectors will detect a rapid rise time for each black element and a slow rise time for each white element. With these detections a control logic can determine what message was written. If desired the detections can be recorded and used to rewrite the blanked sign.

It should be noted that the detection means and method disclosed herein detect only the magnetic state of the pole piece and not the mechanical position of the disc. Thus if a disc has stuck or has fallen off, it will not respond to the magnetic state of the pole piece. Thus the invention detects the magnetic state of the element pole pieces but not always their visual appearance.

The invention is not limited to the detection means illustrated in FIG. 5 but may utilize any other means for discriminating between the rise times.

I claim:

1. In a drive for a rotatably mounted display element distinctively coloured on opposed sides and having a magnet rotatable therewith defining a magnetic axis transverse to the axis of rotation, a pole piece of reversible permanently magnetizable material, designed so that the reversible field of said pole piece will produce opposite orientations of said display element, a coil for energizing said pole piece, and means for determining from the characteristics of current resulting from voltage applied to said coil whether it is reversing or not the polarity of said pole piece.

2. A coil connected to energize in one of two polarities a reversible permanently magnetizable pole piece, where said pole piece is designed to control the orientation of a reversible, swingably mounted, display element, means for determining whether voltage applied to said coil in a predetermined sense is augmenting or reversing the remanence flux in said pole piece.

3. A coil connected to energize, in one of two polarities, a reversible permanently magnetizable pole piece, where said pole piece is located and designed, in combination with a swingably mounted display element, to control the orientation of said element, means for measuring, responsive to the application of voltage connected to energize said coil in a predetermined sense, the rate of rise of current passing through said coil.

4. In a drive for an electromagnetically operated display element movable between two orientations to give a different visual appearance, and has a magnet movable therewith, a pole piece of reversible permanently magnetizable material, designed and arranged so that the two directions of the reversible field of said pole piece will respectively produce by magnetic interaction with said magnet the two orientations of said display element, a coil for energizing said pole piece, and means for determining from the characteristics of current resulting from voltage applied to said coil whether it is reversing or not the polarity of said pole piece.

* * * * *

UNITED STATES PATENT OFFICE

CERTIFICATE OF CORRECTION

Patent No. 4,156,872 Dated May 29, 1979

Inventor(s) Gordon Helwig

It is certified that error appears in the above-identified patent and that said Letters Patent are hereby corrected as shown below:

Column 4 line 29 change Q7 to Q5

Column 4 line 57 change "m" (both occurrences) to

-- $\nu$ --

Column 4 line 61 cancel "after"

Column 5 line 16 cancel "two"

Signed and Sealed this

*Seventeenth* Day of *November 1981*

[SEAL]

*Attest:*

GERALD J. MOSSINGHOFF

*Attesting Officer*

*Commissioner of Patents and Trademarks*